US007370579B2

(12) United States Patent
Kümmet

(10) Patent No.: US 7,370,579 B2
(45) Date of Patent: May 13, 2008

(54) PRINTING BLANKET ASSEMBLY FOR A BLANKET CYLINDER AND METHOD FOR PRODUCING A PRINTING BLANKET ASSEMBLY

(75) Inventor: Andreas Kümmet, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 127 days.

(21) Appl. No.: 10/538,854

(22) PCT Filed: Nov. 27, 2003

(86) PCT No.: PCT/DE03/03941

§ 371 (c)(1),
(2), (4) Date: Jun. 14, 2005

(87) PCT Pub. No.: WO2004/054807

PCT Pub. Date: Jul. 1, 2004

(65) Prior Publication Data

US 2006/0042489 A1 Mar. 2, 2006

(30) Foreign Application Priority Data

| | | |
|---|---|---|
| Dec. 16, 2002 | (DE) | 102 58 975 |
| Feb. 21, 2003 | (DE) | 103 07 382 |
| Feb. 21, 2003 | (DE) | 103 07 383 |
| Jun. 30, 2003 | (DE) | 103 29 270 |
| Nov. 21, 2003 | (DE) | 103 54 436 |

(51) Int. Cl.
*B41F 13/10* (2006.01)

(52) U.S. Cl. ..... 101/375; 101/401.1; 101/415.1

(58) Field of Classification Search ..... None
See application file for complete search history.

(56) References Cited

U.S. PATENT DOCUMENTS

| | | | | |
|---|---|---|---|---|
| 2,525,003 | A | 10/1950 | Smith | |
| 2,963,969 | A | 12/1960 | Sauberlich | |
| 4,452,143 | A | 6/1984 | Heinemann et al. | |
| 4,635,550 | A | 1/1987 | Brands et al. | |
| 4,643,093 | A | 2/1987 | Goar et al. | |
| 4,742,769 | A * | 5/1988 | Zeller | 101/216 |
| 4,907,508 | A * | 3/1990 | Patschorke | 101/401.1 |
| 4,964,338 | A * | 10/1990 | Fantoni et al. | 101/378 |
| 5,090,319 | A * | 2/1992 | Weber et al. | 101/483 |
| 5,125,337 | A * | 6/1992 | Zeller | 101/217 |
| 5,178,068 | A * | 1/1993 | Junghans et al. | 101/415.1 |
| 5,351,615 | A * | 10/1994 | Kobler et al. | 101/217 |
| 5,669,306 | A | 9/1997 | Puschnerat | |

(Continued)

FOREIGN PATENT DOCUMENTS

DE 43 07 320 C1 7/1994

(Continued)

*Primary Examiner*—Jill E. Culler
(74) *Attorney, Agent, or Firm*—Jones, Tullar & Cooper, PC

(57) ABSTRACT

A printing blanket assembly for a blanket cylinder of a rotary printing press includes a dimensionally stable support plate with a printing blanket secured to an outer surface of the support plate. A filler material is arranged on at least one end of the printing blanket. This filler material extends radially at least to an outside surface of the printing blanket. It also extends on the outside of the printing blanket in a longitudinal direction of the printing blanket.

23 Claims, 6 Drawing Sheets

U.S. PATENT DOCUMENTS

| | | | |
|---|---|---|---|
| 5,732,630 A | 3/1998 | Puschnerat et al. | |
| 5,749,298 A | 5/1998 | Castelli et al. | |
| 5,934,194 A | 8/1999 | Puschnerat et al. | |
| 6,779,449 B1 * | 8/2004 | Hoffmann et al. | 101/375 |

FOREIGN PATENT DOCUMENTS

| | | |
|---|---|---|
| DE | 43 07 320 C2 | 7/1994 |
| DE | 195 21 645 A1 | 1/1997 |
| DE | 195 43 584 C1 | 7/1997 |
| DE | 195 47 917 A1 | 7/1997 |
| FR | 1367860 | 6/1994 |

* cited by examiner

Fig. 6
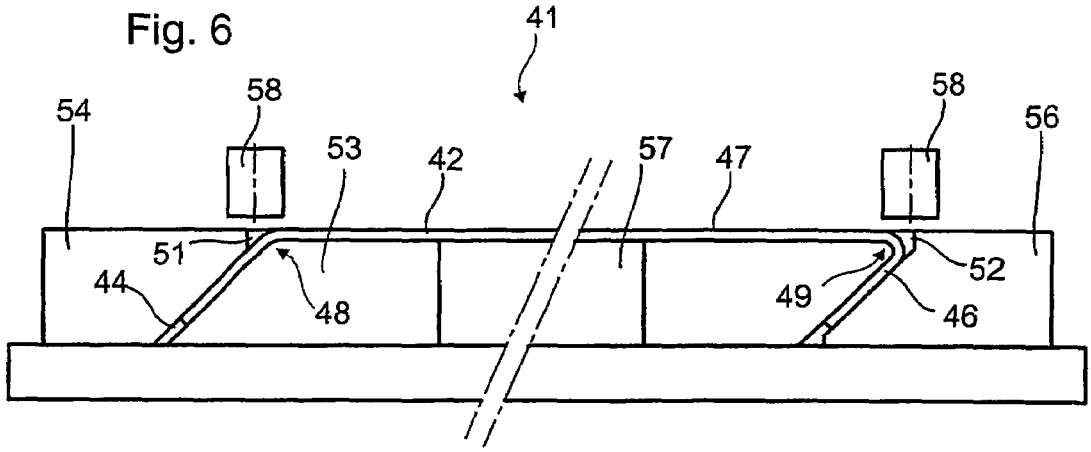
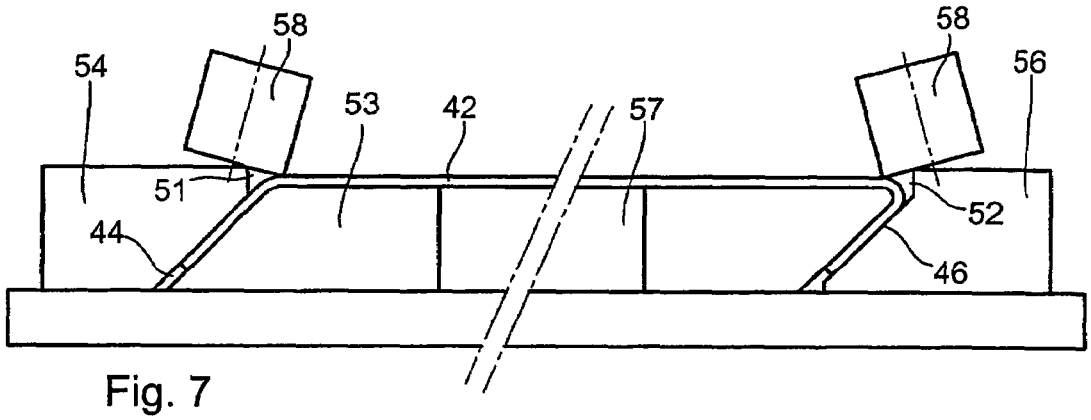
Fig. 7
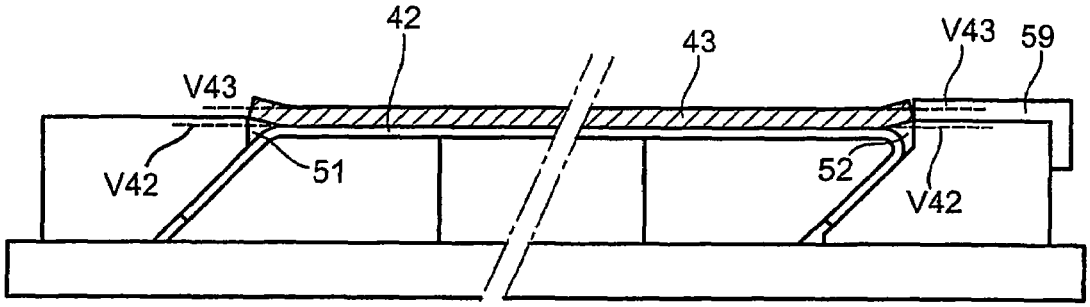
Fig. 8

PRINTING BLANKET ASSEMBLY FOR A BLANKET CYLINDER AND METHOD FOR PRODUCING A PRINTING BLANKET ASSEMBLY

CROSS-REFERENCE TO RELATED APPLICATIONS

This application is the U.S. national phase, under 35 USC 371, of PCT/DE2003/003941, filed Nov. 27, 2003; published as WO 2004/054807 A1 on Jul. 1, 2004; and claiming priority to DE 102 58 975.5, filed Dec. 16, 2002; to DE 103 07 382.5, filed Feb. 21, 2003; to DE 103 07 383.3, filed Feb. 21, 2003; to DE 103 29 270.5, filed Jun. 30, 2003; and to DE 103 54 436.4, filed Nov. 21, 2003, the disclosures of which are expressly incorporated herein by reference.

FIELD OF THE INVENTION

The present invention is directed to printing blanket units or assemblies of a printing blanket cylinder of a printing press, as well as to methods for producing such a printing blanket assembly. The assemblies include a support plate and a printing blanket. A filler material is arranged on at least one end of the printing blanket assembly.

BACKGROUND OF THE INVENTION

Printing blanket assemblies or units are fastened on a printing blanket cylinder of a printing press and are used in offset printing for transferring the print image from the forme cylinder to the web of material to be imprinted. To provide the required mechanical strength for the printing blanket unit, a support plate which is made, for example, of sheet steel or sheet aluminum, is employed. A printing blanket, which can be configured in the manner of a rubber blanket, for example, is fastened on the outside of the support plate. Folded or angled plate end legs, which are free of the printing blanket, are provided at the leading end and/or the trailing end of the support plate. These legs are used for fixing the printing blanket unit in place on the printing blanket cylinder. These legs can be inserted, for example, into a slit which is provided in the printing blanket cylinder and can be fixed in place in the slit to secure the blanket assembly to the blanket cylinder.

A problem in connection with known printing blanket units is that the printing blanket does not cover the support plate seamlessly. A gap frequently remains between the leading and the trailing ends of the printing blanket and the support plate. No printing ink can be transferred, in the area of the gap, to the web of material to be imprinted. Furthermore, the print image is of reduced quality at the edges of the printing blanket in the direction toward the gap. Therefore, several solutions are known in the prior art, by the use of which solutions the disadvantages caused by the provision of a gap between the ends of the printing blanket have attempted to be avoided.

A printing blanket unit is known from DE 195 47 917 A1. The two ends of the printing blanket overlap each other with a positive connection in order to reduce the gap that typically is located between the ends of the printing blanket.

A printing blanket unit is known from DE 195 21 645 A1. A slide is arranged between the two legs of the support plate.

In this prior art arrangement, the outward pointing end of the slide is connected with a filler element. The gap between the ends of the printing blanket is closed by the filler element.

A printing blanket unit is known from DE 195 43 584 C1. In this device the printing blanket is put together from a plurality of layers. A top layer of the plurality of layers covers the front areas of the layers underneath it and in this way forms a protrusion, by the use of which protrusion the gap at the ends is reduced.

U.S. Pat. No. 5,749,298 discloses a printing blanket unit with a support plate, whose ends are folded. The printing blanket, which is arranged on the support plate, is sealed at the front.

U.S. Pat. No. 4,635,550 discloses a printing blanket unit with a printing blanket arranged on a support plate. A support element is arranged in the groove in the support plate, which support element supports the projecting end of the printing blanket.

U.S. Pat. No. 2,525,003 shows a device for producing a printing blanket unit.

U.S. Pat. No. 4,643,093 discloses a printing plate with a reinforced end and an associated device.

SUMMARY OF THE INVENTION

The object of the present invention is directed to printing blanket units of a printing blanket cylinder of a printing press, as well as to methods for producing such printing blanket units.

In accordance with the present invention, this object is attained by the provision of a printing blanket unit for use on a printing blanket cylinder of a rotary printing press. The printing blanket unit has a dimensionally stable support plate and a printing blanket which is fastened on an exterior surface of the support plate. A filler material is arranged on at least one end of the printing blanket support plate and may extend at least as far as an end of the printing blanket. This filler material, which is embodied as a support element, extends in a longitudinal direction of the printing blanket on the interior of the printing blanket and extending longitudinally away from the support plate. The support plate typically has two folded legs with the filler material being on folds that form the folded legs.

An advantage of the printing blanket unit or assembly in accordance with the present invention lies, in particular, in that by the use of this printing blanket unit or assembly, in which a filler material is arranged in the area of a virtual extension of the exterior of the printing blanket support plate in the longitudinal direction of the printing blanket, a gap between the ends of the printing blanket is minimized. In this connection, it is easily within the scope of the present invention for the protrusion of the filler material to be selected to be so large that, in its installed position, the two ends of the printing blanket come to rest against each other.

The filler materials, which are also called support elements, are used for supporting a counter-cylinder, and in particular for supporting a forme cylinder or a plate cylinder, in the radial direction.

A multitude of fastening solutions are possible for use in fastening the filler material on the printing blanket unit. In accordance with a preferred embodiment of the present invention, the filler material is fastened on the support plate in the area of the plate fold and/or on the inside of the printing blanket by a material-to-material contact, such as, in particular by being glued on or by being applied by vulcanization.

The filler material can be produced in a particularly simple manner if it is made using the same material as is used for the printing blanket, such as, for example, of rubber or a similar material, or of the same material as the support plate, such as, for example, of metal. It is then conceivable, in particular, to form the filler material as one piece together with the printing blanket or with the support plate.

Printing blanket materials, which have only a minimal gap, can be produced in a relatively uncomplicated way by using the production method in accordance with the present invention.

The execution of the method in accordance with the present invention takes place in a device located outside of the printing press, in which device, at least the support plate, with the already applied printing blanket attached, is arranged. The flowable filler material is introduced into a mold of the device, where it is applied to the ends of the support plate, at least one leg of which support plate has already been folded.

The filler material is placed in the areas around the folds of the legs and is shaped by slides which are attached to the device which is located separate from the printing press. Thereafter, the filler material is processed in accordance with the required measurements.

In an alternative method in accordance with the present invention, filler material is applied to the support plate, which support plate has at least one folded end and on which support plate the printing blanket has already applied, in the area of the fold of the support plate. This filler material is connected with a front face of the at least one folded end of the support plate.

In another preferred embodiment of the present invention, the printing blanket unit or assembly has at least one end of a greater thickness than in an area of the unit or assembly located between the two ends, so that the outer surface of the printing blanket unit in the area of this end, protrudes, in the radial direction of the cylinder at least partially past the virtual extension of the exterior of the printing blanket.

BRIEF DESCRIPTION OF THE DRAWINGS

Preferred embodiments of the present invention are represented in the drawings and will be described in what follows.

Shown are in.

DESCRIPTION OF PREFERRED EMBODIMENTS

Figure 2:
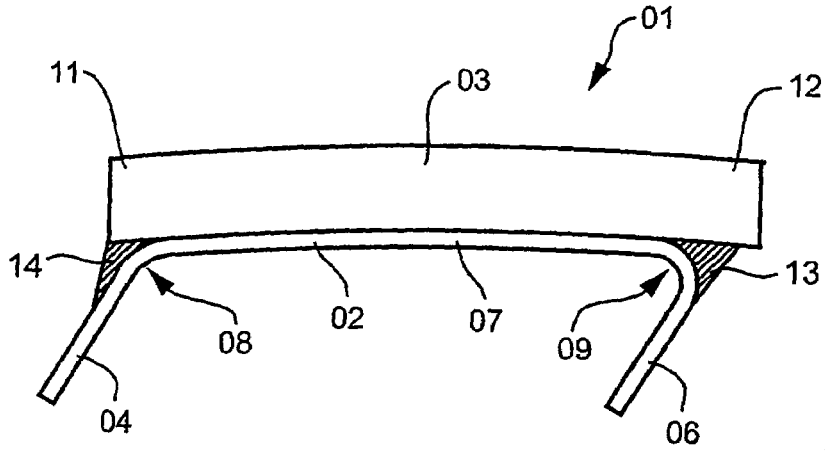
Figure 3:
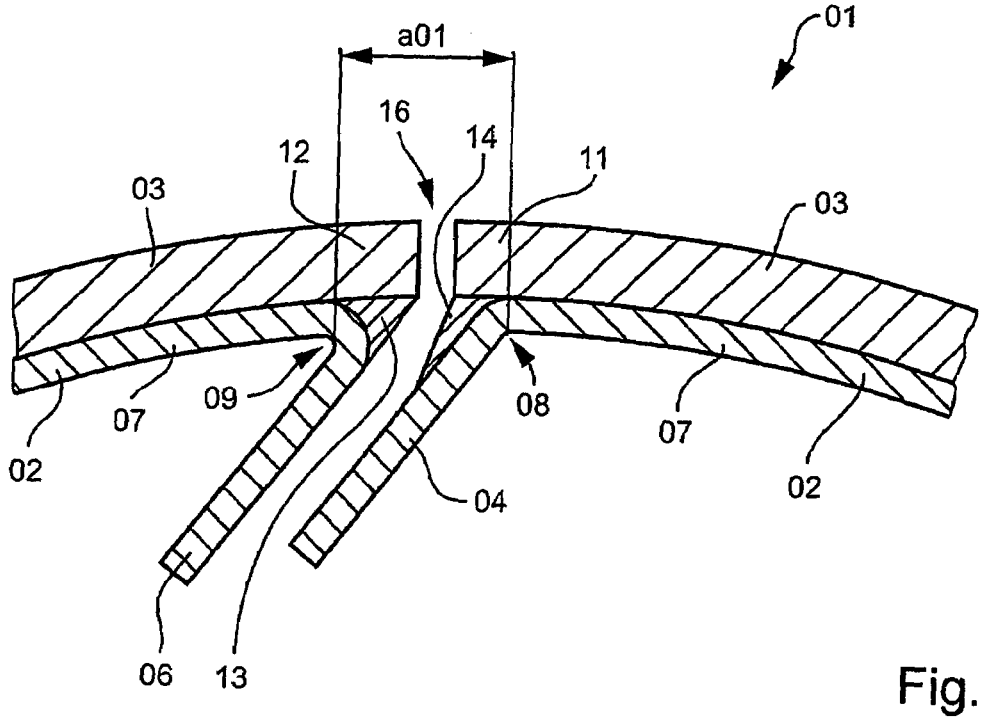
Figure 4:
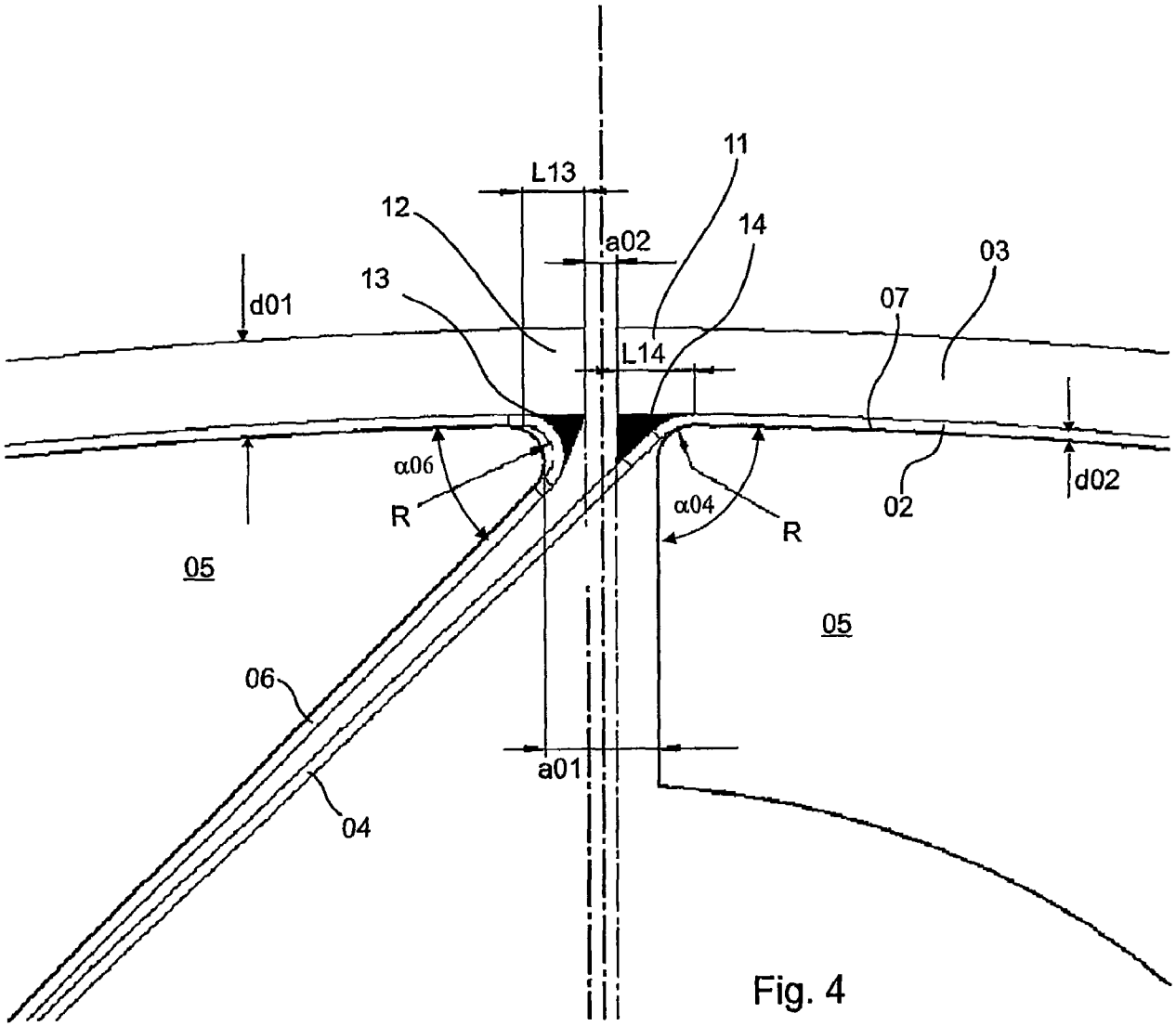

A printing blanket unit in accordance with the present invention and as represented at 01, 17, or 41 in FIG. 1 to FIG. 12, and whose thickness d01, as seen in FIG. 4 is, for example, 1.6 mm, consists of a dimensionally stable support plate 02, 18 or 42, respectively, of a thickness d02, as seen in FIG. 4, of approximately 0.2 mm to 0.5 mm, and of a printing blanket 03, 19 or 43, respectively, fastened on the support plate 02, 18, 42. The support plate 02, 18 or 42 is made of metal, such as, for example, sheet steel or sheet aluminum. The printing blanket 03, 19 or 43 can be embodied, for example, in the manner of a rubber blanket 03, 19, 43 respectively, and in particular can be fabricated several layers of different materials.

The leading and trailing printing blanket unit securement legs 04 and 06, 21 and 22, or 44 and 46 respectively, which are free of and are not overlaid by the printing blanket, are folded downward at the leading and at the trailing end of the support plate 02, 18, 42 by the use of a folding machine which is not shown, so that the now angled or folded legs 04, 06, 21, 22, 44, 46 can later be used for fastening the printing blanket unit on a printing blanket cylinder 05, as shown in FIG. 4. The folded leg 06, 21, 46 at the leading end, together with the support plate 02, 18, 42 following it, forms an acute opening angle $\alpha$06, in particular of 30 to 60 degrees, and preferably of 40 to 50 degrees. The folded leg 04, 22, 44 which is situated at the plate trailing end, together with the center element 07, 35, 47 of the adjoining support plate 02, 18, 42, respectively, following it, has an opening angle $\alpha$04 of 45 to 150 degrees, and in particular of 80 to 100 degrees. In a preferred embodiment of the present invention, the angle size $\alpha$04 is 120 to 150 degrees. The center element 07, 35, 47 of the support plate 02, 18, 42 respectively, which is completely covered by the printing blanket 03, 19, 43, respectively and which is facing toward the outside, extends between the legs 04 and 06, 21 and 22, or 44 and 46, respectively. Fold lines or fold zones 08 and 09, 27 and 28, or 48 and 49 are located at, and extend at the transition between the center element 07, 35, 47 on the one side and the legs 04, 22, 44, or 06, 21, 46 on the other side.

Figure 1:
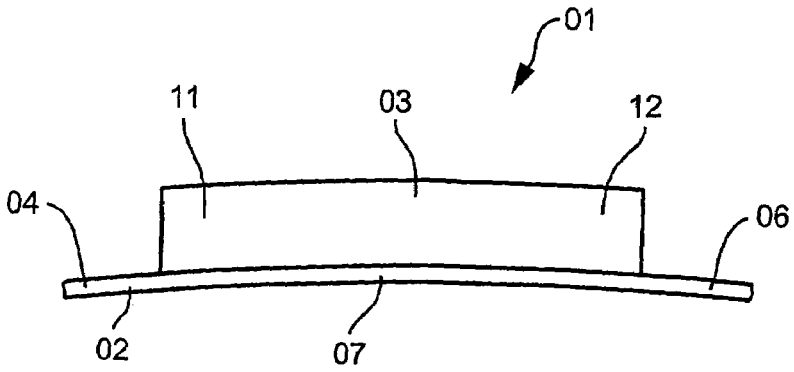
FIG. 1, a first preferred embodiment of a printing blanket unit, in accordance with the present invention, in a first production phase, in FIG. 2, the printing blanket unit shown in FIG. 1, in a second production phase, in FIG. 3, the printing blanket unit shown in FIG. 1 and FIG. 2 and in a third production phase, in FIG. 4, a second preferred embodiment of a printing blanket unit in accordance with the present invention, in FIG. 5, a third preferred embodiment of a printing blanket unit in a partial cross sectional view, in FIGS. 6 and 7, first and second embodiments of a production method for producing a printing blanket unit in accordance with the present invention, in FIG. 8, a preferred embodiment of the printing blanket unit made in accordance with the production method of FIG. 7 and with thickened ends, in FIGS. 9 to 11, preferred embodiments of further production methods for a printing blanket unit, and in FIG. 12, a preferred embodiment of the printing blanket unit in accordance with FIG. 3 with thickened ends.

In the printing blanket unit production phase, which is represented in FIG. 1, the support plate 06, as well as the printing blanket 03, are both configured as being approximately flat, so that the printing blanket 03 can be fastened on the support plate 02 free of tension and deformation. To this end, the printing blanket 03 can be glued and/or can be vulcanized to the support plate 02 using any suitable process.

The legs 04 and 06, which are free of the printing blanket 03, are folded downward in a folding machine, in a procedure which is not specifically depicted, and the result is shown in FIG. 2.

The folds 08 and 09 or fold lines or fold zones are produced in the folding machine in such a way that the result is that each of the two ends 11 and 12 of the printing blanket 03 protrude some distance past their respective one of the folds 08 and 09. A resultant space between the protruding ends 11 and 12 of the printing blanket 03 on the one hand, and the support plate 02 on the other, is filled with a suitable filler material 13, 14, which filler material 13, 14 is also called a support element 13 and 14. The filler material 13 and 14 can be provided, for example, by applying a curable rubber material, for example.

The filler material 13, 14 is preferably deformable and/or flowable while it is being applied.

A portion of the resultant printing blanket unit 01 is shown, in its installed position, in FIG. 3. It can be seen in FIG. 3 that in the installed position, the two support plate legs 04 and 06 extend at complementary angles to, and parallel to each other, so that they can be fastened together in a slit in a printing cylinder, which is not specifically represented. Because of the protrusion of the ends 11 and 12 of the printing blanket 03. a width of the resultant gap 16 between the ends 11 and 12 of the printing blanket 03 is minimized. It is possible, for example, to minimize the width of the gap 16 to a width of less than 0.5 mm.

The distance between the folds or fold lines or fold zones 08, 09 substantially corresponds to the distance a01 of the opening in the cylinder surface and is less than 3 mm. In particular, the opening a01 is less than 2.0 mm.

Because of the support of the protruding ends 11 and 12 of the printing blanket 03 by the filler material 13 and 14, a suitable print transfer from the printing blanket 03 to a web of material to be imprinted is achieved in this area defined by the blanket protruding ends 11 and 12.

As represented in FIG. 4, a distance a02 between the oppositely located ends 11, 12 of the printing blanket 03 is 0.2 mm to 0.8 mm, and preferably is 0.3 mm to 0.7 mm. In a particularly preferred embodiment, the distance a02 is 0.4 mm to 0.6 mm, and in particular is 0.5 mm.

The fold 08 of the trailing end leg 04 has a radius R of 0.6 mm to 1.2 mm, and in particular of 0.8 mm, as shown in FIG. 4.

The fold 09 of the leading end leg 06 has a radius R of 0.3 mm to 0.7 mm, and in particular of 0.5 mm, also as shown in FIG. 4.

A length L13, L14 of each respective support element 13, 14 in the circumferential direction is 0.4 mm to 1.0 mm, and in particular is from 0.1 mm to 1.3 mm. In a preferred embodiment of the present invention, a length L13, L14 of each of the support elements 13, 14 is 0.7 mm.

As represented in FIG. 4, the filler material 13, 14 can be formed in different shapes. For example, the filler material 13 has an acute angle, while the filler material 14 is shaped generally right-angled.

The measurements described for FIG. 4 can be substantially transferred to all of the embodiments of the present invention, which are represented in all of the drawing figures.

Figure 5:
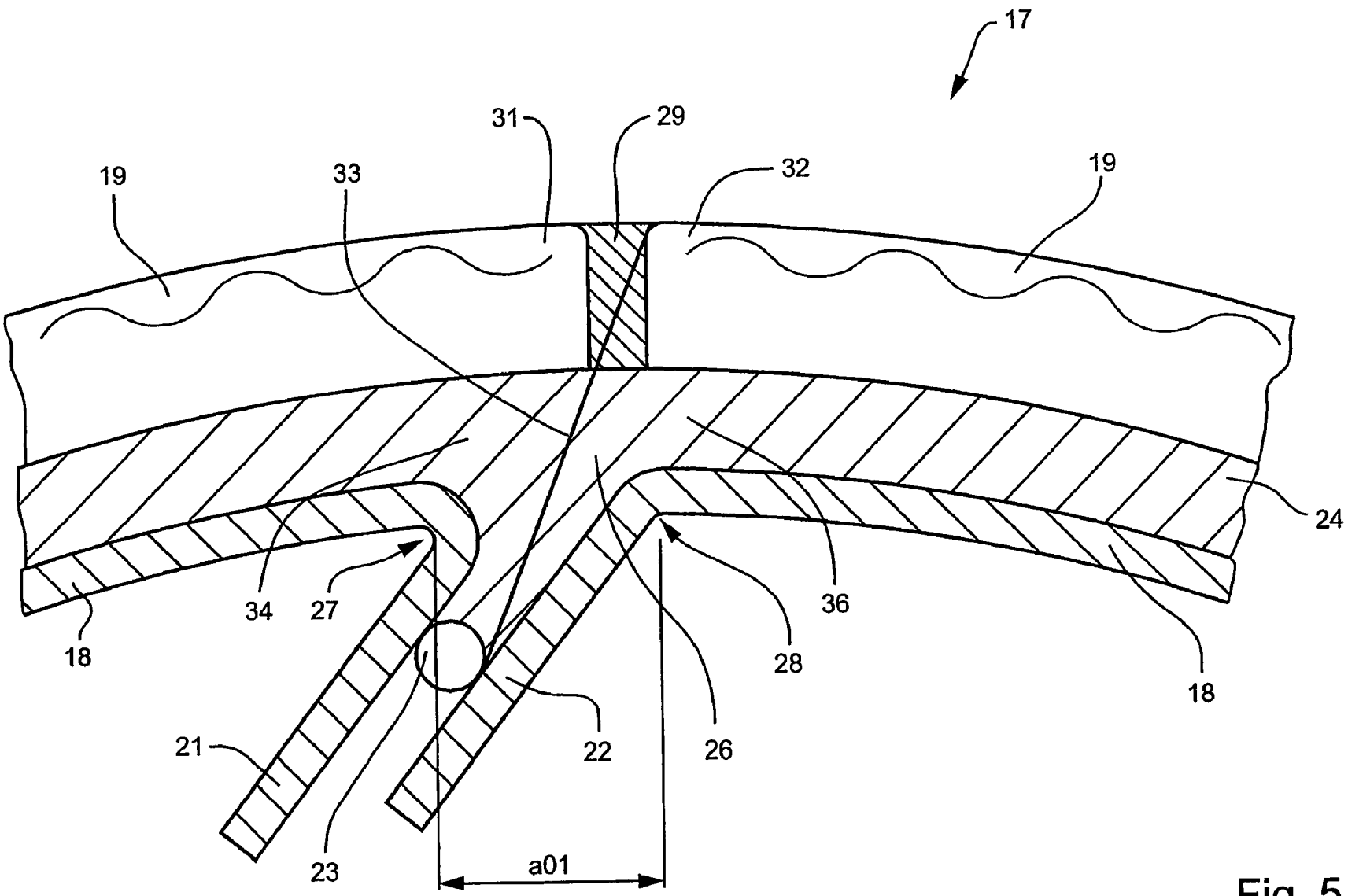

A third embodiment of a printing blanket unit, in accordance with the present invention, is represented in FIG. 5. This printing blanket unit also has a support plate 18 of sheet steel and a printing blanket 19 of rubber. To produce the printing blanket unit, first the support plate 18 is fastened, by utilization of its legs 21 and 22, on a processing cylinder, whose shape corresponds to the shape of the printing blanket cylinder in the printing press on which the printing blanket unit is ultimately to be fastened. Following this placement, a sealing element 23 is inserted into the gap 26 between the legs 21 and 22 and is used for closing the gap 26 at the bottom of the gap 26. Thereafter, a liquid elastomer material is applied to the outside of the support plate 18 in such a way that the support plate 18 is enclosed in a continuous sub-structure layer 24 of this liquid elastomer. In the area of the oppositely located legs 21 and 22 of the support plate, the sub-structure layer 24 fills the gap 26 which is the space between the oppositely located folds or fold lines or fold zones 27 and 28.

Subsequently, a suitable printing blanket 19 is fastened on the sub-structure layer 24, by being, for example, applied by vulcanization. The gap 26, which continues between the ends 31 and 32 of the printing blanket 19, is closed by filler material, here also called sealing material 29, which, for example, may be a curable elastomeric material, and which is thereafter ground at the outside for producing a uniform cylindrical outer surface.

At the end of the process, the sealing material 29 and the sub-structure layer 24 are cut through along a cutting line 33, as seen in FIG. 5, so that the printing blanket unit can be removed from the processing cylinder and can subsequently be mounted on a printing blanket cylinder. Separate support elements 34 and 36 are formed by the separation of the sub-structure layer 24, which separate support elements 34 and 36 support the respective ends 31 and 32 of the printing blanket 19 from below. In the course of mounting the printing blanket unit on a printing blanket cylinder, the lateral faces of the support elements 34 and 36, which lateral faces were formed by the cut along the cutting line 33, can come into a positively connected contact with each other.

FIGS. 6 to 8 show preferred embodiments of a different production method for the production of a printing blanket unit similar in structure to the one depicted in FIG. 3.

As previously described, at least one end of the support plate 42 is folded. The support plate 42 is now placed on a base body 53 of a device 41 which device 41 is provided with at least one slide 54, 56, which slide or slides 54, 56 will be described in what follows. At least one of the slides 54, 56 is movable with respect to the base body 53 and/or with respect to the other slide 56, 54. The geometry of this base body 53 is matched to the geometry of the support plate 42. Both slides 54, 56 of the device 41 are initially open. The support plate 42 is now adjusted to the required cylinder circumference or to the required folding measure by the use of an adjustment mechanism 57. Both slides 54, 56 are closed. The filler material 51, 52 is subsequently poured or is pressed into the gap in a positively connected manner. Depending on the shape of the slides 54, 56, a flat sub-structure, such as one which is flush with the support plate 42, or a raised sub-structure is attained. The slides 54, 56 act as molds 54, 56 for the filler material 51, 52. In this case, at least one of the filler materials 51, 52 protrudes in the radial direction past a virtual extension V42 of the exterior of the support plate 42. Now the filler material 51, 52 is pulled or is ground to be flush by the use of a further device 58. Subsequently the printing blanket 43 is applied to the support plate 42 and to the filler material 51, 52. This can be performed with the aid of a stop 59, which can be placed against an end of the printing blanket 43, as seen in FIG. 8. At the end of the production process, the slides 54, 56 are opened and the printing blanket unit is vulcanized. This vulcanization can be performed inside the device 41, and can also be accomplished outside of the device 41.

Figure 9:
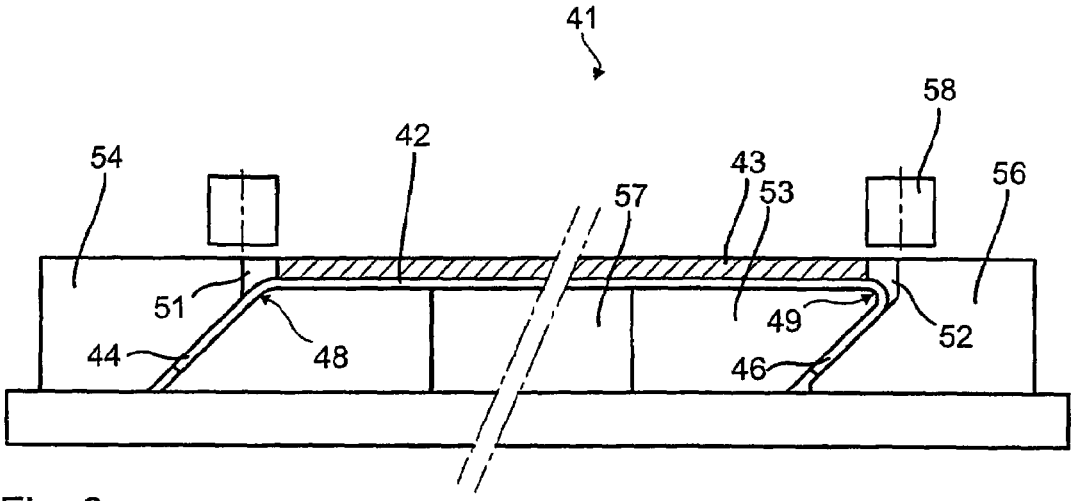
Figure 10:
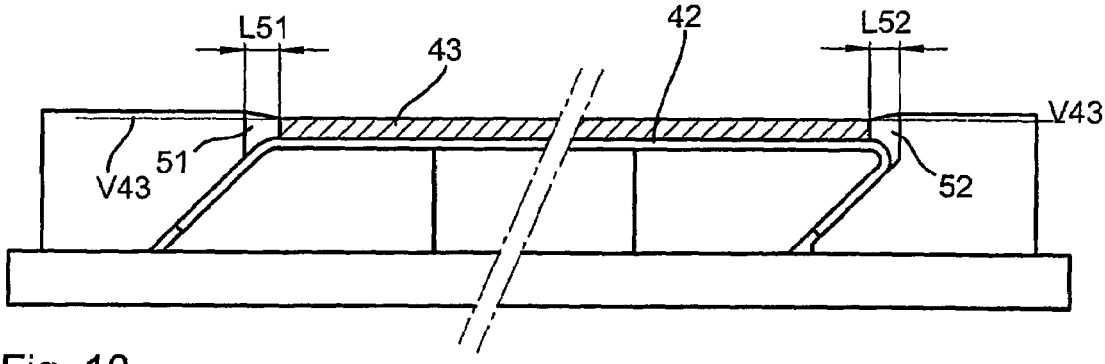

FIGS. 9 and 10 show a particularly preferred production method for making a further printing blanket unit. This embodiment makes it possible to close or to reinforce a groove of a cylinder.

In the method shown in FIGS. 9 and 10, the filler material 51, 52 extends in a virtual extension V43 of the exterior of the printing blanket 43 in the longitudinal direction, i.e. in the circumferential direction of the printing blanket 43. In this case, the filler material 51, 52 can protrude, in the longitudinal direction, past one end 61, 62, as well as past both ends 61, 62 of the printing blanket 43. In the radial direction, the filler material 51, 52 can protrude at least partially past the virtual extension V43 of the exterior of the printing blanket 43, as may be seen in FIGS. 10 and 11.

This embodiment is accomplished by the following production method. As previously described, at least one end of the support plate 42 is folded. The printing blanket 43 is then applied to the support plate 42. In this case, it is unimportant whether or not the printing blanket 43 has already been vulcanized. Subsequently, the slides 54, 56 are closed. Now, the filler material 51, 52, for use in closing and reinforcing a groove, is pressed or is poured in. Depending on how the slide 54, 56 is configured, a corresponding shape of the filler material 51, 52 is attained. Thereafter, the filler material 51, 52 is shaped to the exact size. Depending on the needs, the vulcanization process can subsequently take place either inside of or outside of the device 41.

The two above-described production methods thus differ in that, in the embodiments in accordance with FIGS. 6 to 8, the filler material 51, 52 is arranged between the support plate 42 and the printing blanket 43, wherein the filler material 51, 52 is first arranged on the support plate 42 and then the printing blanket 43 is put in place. In the embodiment in accordance with FIGS. 9 to 11, the support plate 42 is connected with the printing blanket 43, and the filler material 51, 52 is then introduced. An exterior surface of the filler material 51, 52, which is arranged on the exterior in the radial direction, is not covered by the printing blanket 43.

Figure 11:
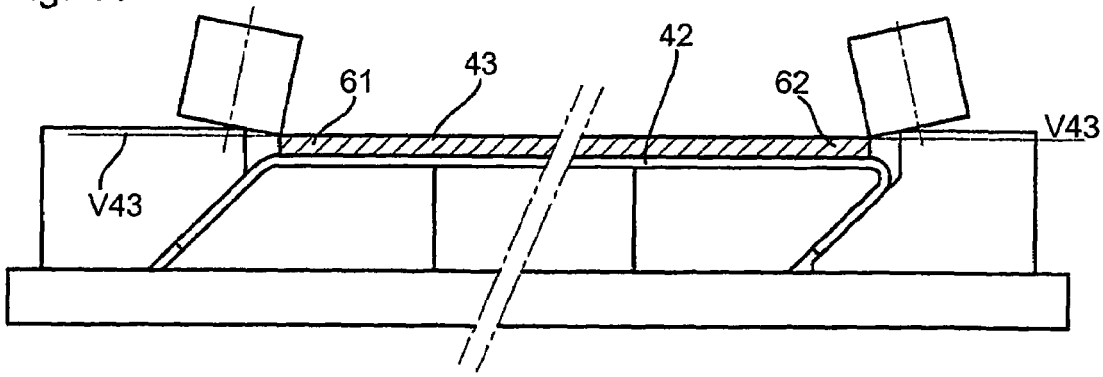
Figure 12:
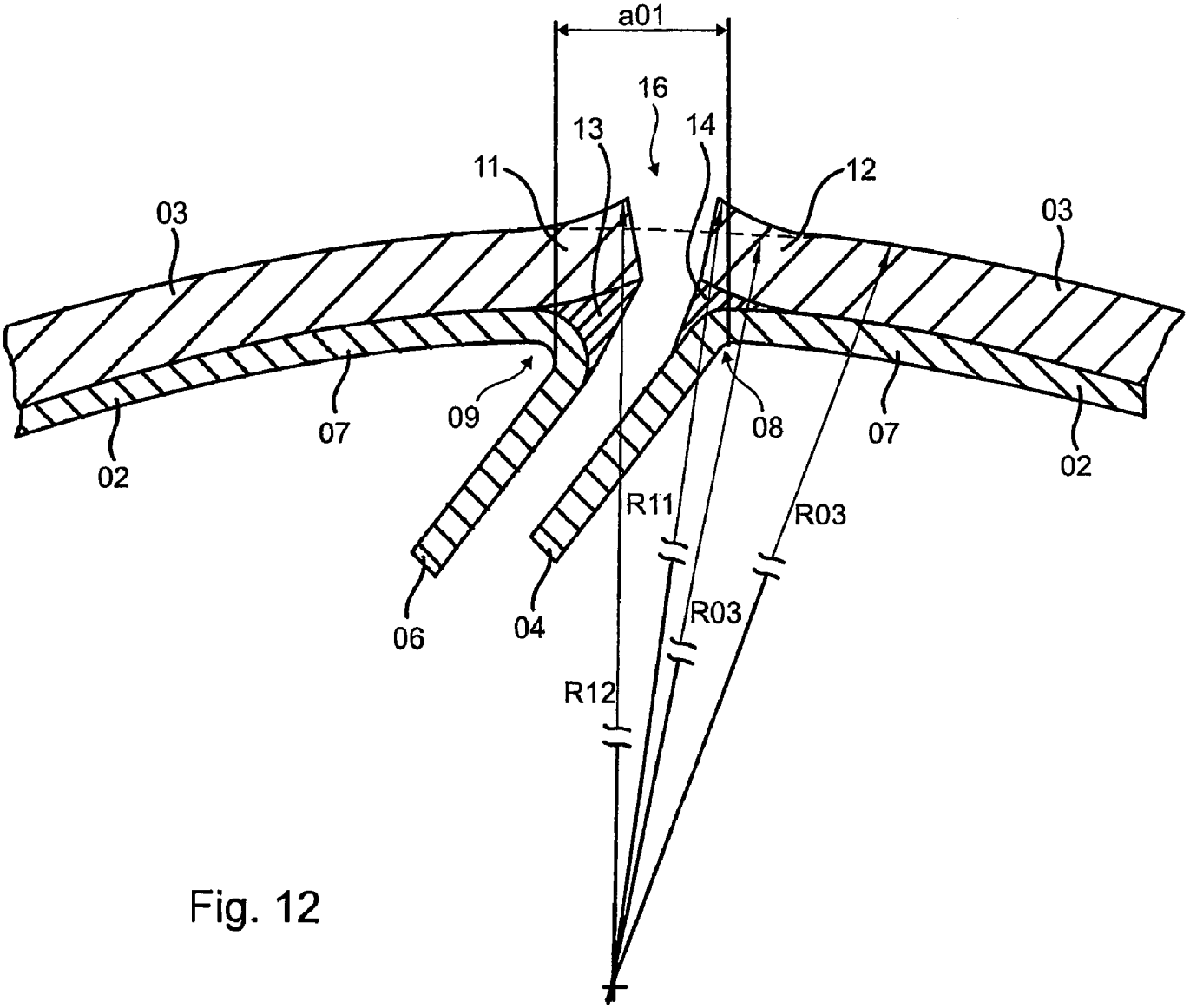

As represented in FIGS. 8, 11 and 12, the printing blanket unit 41 has at least one end of a greater thickness than an area which is located between the two ends, so that the outer surface of the printing blanket unit, in the area of this end, protrudes at least partially past the virtual extension V43 of the exterior of the printing blanket 43. In particular, this outer surface is embodied in a wedge shape. For thickening the end, the filler material 51, 52 is arranged at the ends of the printing blanket 43. In FIGS. 8 and 12, an undercoating of the printing blanket at 43 can be seen, while in FIG. 11, a filling of the printing blanket 43 is represented.

The embodiment with thickened ends in FIG. 8, in the state where it is mounted on the cylinder, correspondingly also applies to FIG. 11.

In the state where the printing blanket unit is mounted on the printing blanket cylinder, this thickened end, or both thickened ends extend in a radial direction past a virtual extension of the adjoining rubber blanket. An effective radius of the mounted rubber blanket is thus greater in the area of the ends. The area located in between is very much larger, and in particular is at least ten times greater, than the area of the ends. The thickening preferably extends in the circumferential direction by less than 10 mm, and in particular it extends less than 5 mm.

Accordingly, in the state where the printing blanket unit is mounted on the printing blanket cylinder, a radius R11 R12, as seen in FIG. 12 of the cylinder, in relation to the exterior of the printing blanket 03, or in relation to the outside of the filler material 13, 14, is greater, at least in the area of an end of the printing blanket unit, than a radius R03 of the cylinder, in relation to the exterior of the printing blanket, in the area between the two ends.

The printing blanket unit in accordance with the present invention has an increased radius R11, R12, in the circumferential direction, of less than 10 mm, and in particular of less than 5 mm.

In accordance with all of the disclosed methods, the filler material 13, 14, 29, 51, 52 is introduced in a flowable, deformable state at least to one end of the two ends of the printing blanket unit. The filler material 13, 14, 29, 51, 52 is arranged, in the longitudinal direction, at least partially on a fold 08, 09, 27, 28, 48, 49 of the folded leg 04, 06, 21, 22, 44, 46 of the support plate 03, 18, 42 and protrudes, in the circumferential direction, past the fold 08, 09, 27, 28, 48, 49. After its application, the outside of the filler material 13, 14, 29, 51, 52 can be shaped to an appropriate exact size. Preferably, the filler material 13, 14, 29, 51, 52 can be embodied as one piece. The materials of the printing blanket 03, 04 and of the filler material 13, 14, 29, 51, 52 can be identical or they can be different.

As represented in FIG. 10, in a particularly preferred embodiment of the present invention, the length L51, L52 of the filler material 51, 52 is more than 0.1 mm, and in particular is more than 0.4 mm. However, this length is less than 2 mm, and in particular is less than 5 mm.

For producing printing blanket units, with printing blanket units which initially lie stretched out, either preferably flat or slightly arched, the filler material 51, 52, or the support elements 13, 14 or are is introduced at ends of the printing blanket unit facing away from each other, except for the preferred embodiment of FIG. 5.

A device 41 consisting of several parts, can be employed to produce the printing blanket unit, wherein at least two elements of the device 41, such as, for example, the slides 54, 56, are movable in relation to each other. In connection with this, it is possible, for example for use in producing thickened ends of the printing blanket unit, that at least the surface of the printing blanket, which is resting against the filler material 51, 52 protrudes, in the direction of the exterior of the printing blanket unit, at least partially past the virtual extension V43 of the exterior of the printing blanket 43, or that at least the surface of the printing blanket resting against the filler material 51, 52 protrudes in the direction of the exterior of the printing blanket unit at least partially past the virtual extension V42 of the exterior of the support plate 42 with the printing blanket 43 not yet applied to the support plate 42. The spacing between the two elements, for example between the two slides 54, 56, should be adjustable in the longitudinal direction of the printing blanket unit. At least one surface of one of the two elements, such as the slides 54, 56, rests against the filler material 51, 52, and at least one surface can rest against a folded leg 44, 46 of the support plate 42. At least the surface resting against the filler material 51, 52 can protrude, in the direction of the exterior of the printing blanket unit, at least partially past the virtual extension V43 of the exterior of the printing blanket 43. Alternatively, at least the surface of the printing blanket resting against the filler material 51, 52 can protrude in the direction of the exterior of the printing blanket unit at least partially past the virtual extension V42 of the exterior of the support plate 42 with the printing blanket 43 not yet applied to the support plate 42. At least one other device 58, such as, for example, a tool 58 for processing at least the outside of the filler material 51, 52, can be arranged on the device 41.

At least one support 53, such as, for example, the base body 53, should be arranged in the device 41 for use in receiving the support plate 42. The inside of the support plate 42 rests on this support 53.

The support 53 can consist of several elements. At least one element of the support 53 cooperates with a leading leg 46 of the support plate 42. Another element of the support 53 works with the trailing leg 44 of the support plate 42.

Preferably one element of the support 53 can change its position with respect to the other element of the support 53.

The device 41 can also have elements for folding the ends of the support plate 42. It can thus be embodied as a folding machine.

Embodiments wherein the support plate has only one folded leg are not specifically represented. In these cases, the filler material can be arranged on the fold of the one folded leg and on the other, non-folded end of the support plate.

The second end of the printing blanket unit is then not arranged in any groove. Instead it is positioned only on the exterior of the barrel of the printing blanket cylinder.

It applies to all of the above-described printing blanket units and methods, that the support or filler material 13, 14, 34, 36, 51, 52 is arranged, or can be arranged on the printing blanket unit, prior to the mounting of the printing blanket unit on the printing blanket cylinder.

The support or filler material 13, 14, 34, 36, 51, 52, can also be used, for example, for supporting a counter-cylinder in the radial direction, because the printing blanket cylinder is in contact with a counter-cylinder, such as, for example, a forme cylinder or a plate cylinder. The forme cylinder has at least one groove, in which at least one associated printing plate is fastened. In this case, the filler material 13, 14, 34, 36, 51, 52 works together with a printing plate of the counter-cylinder in that they mutually support each other.

While preferred embodiments of a printing blanket assembly for a blanket cylinder and methods for producing a printing blanket assembly, in accordance with the present invention have been set forth fully and completely hereinabove, it will be apparent to one of skill in the art that various change in, for example, the structure of the printing press in which the blanket cylinder is used, the drive for the blanket cylinder, and the like could be made without departing from the true spirit and scope of the present invention which is accordingly to be limited only by the appended claims.

What is claimed is:

1. A printing blanket unit for a printing blanket cylinder of a printing press comprising:

a dimensionally stable support plate including a plate central element, with a plate exterior surface, and leading and trailing support plate ends, said support plate ends being formed at an angle, with respect to said plate exterior surface and forming leading and trailing printing blanket unit securement legs;

fold zones located at a transition between said plate central element and each of said leading and trailing printing blanket unit securement legs;

a printing blanket fastened on said plate exterior surface of said plate central element and having printing blanket ends spaced apart in a longitudinal direction of said printing blanket, and a printing blanket exterior surface; and a filler material on at least a portion of each of said leading and trailing support plate ends and being secured to said fold zones, said filler material being embodied as a support element, said filler material secured to each of said fold zones engaging a respective one end of said printing blanket and extending from its respective one of said fold zones in said longitudinal direction of said printing blanket at a length greater than 0.1 mm, wherein when said printing blanket unit is mounted on the printing blanket cylinder, said filler material on one of said leading and trailing printing blanket unit securement legs is out of contact with said filler material on the other of said leading and trailing printing blanket unit securement legs and further wherein said printing blanket ends are out of contact with each other.

2. The printing blanket unit of claim 1 wherein said length is greater than 0.4 mm.

3. The printing blanket unit of claim 1 wherein said length is less than 2 mm.

4. The printing blanket unit of claim 1 wherein said length is less than 5 mm.

5. The printing blanket unit of claim 1 wherein said filler material has a filler material thickness and said printing blanket has a printing blanket thickness which is less than said filler material thickness.

6. The printing blanket unit of claim 1 wherein said at least one of said securement legs defines an acute angle with said support plate.

7. The printing blanket unit of claim 6 wherein said at least one of said securement is arranged at said leading end of said support plate of said printing blanket unit.

8. The printing blanket unit of claim 1 wherein said securement leg at said trailing end of said support plate forms an opening angle of between 45° and 150° with said support plate.

9. The printing blanket unit of claim 8 wherein said angle is between 80° and 100°.

10. The printing blanket unit of claim 8 wherein said angle is between 120° and 150°.

11. The printing blanket unit of claim 1 wherein said filler material extends in said longitudinal direction of said printing blanket at a virtual extension of said support plate exterior surface.

12. The printing blanket unit of claim 1 wherein said support plate is metal.

13. The printing blanket unit of claim 1 wherein said printing blanket is multi-layered.

14. The printing blanket unit of claim 1 wherein said filler material is one piece.

15. The printing blanket unit of claim 1 wherein said printing blanket is a material which is different from said filler material.

16. The printing blanket unit of claim 1 wherein said printing blanket is the same material as said filler material.

17. The printing blanket unit of claim 1 wherein said filler material is placed on said support plate before said printing blanket is placed on said support plate.

18. The printing blanket unit of claim 1 further including a forme cylinder in contact with said printing blanket unit on the printing blanket cylinder.

19. The printing blanket unit of claim 18 further including at least one printing plate on said forme cylinder.

20. The printing blanket unit of claim 19 wherein said filler material and said printing plate mutually support each other.

21. The printing blanket unit of claim 18 further including at least one interruption on a surface of said forme cylinder.

22. A printing blanket unit for a printing blanket cylinder of a printing press comprising:

a dimensionally stable support plate including a plate exterior surface with leading and trailing plate ends;

a printing blanket fastened on said plate exterior surface and having printing blanket ends spaced apart in a longitudinal direction of said printing blanket, and a printing blanket exterior surface; and a filler material on at least a portion of said support plate and being embodied as a support element, said filler material engaging at least one end of said printing blanket and extending radially at least in part, past a virtual extension of said printing blanket exterior surface and extending from said at least one of said printing blanket ends in said longitudinal direction of said printing blanket at a length greater than 0.1 mm, wherein when said printing blanket unit is mounted on the printing blanket cylinder, said filler material on said at least one end of said printing blanket is not connected with filler material on another end of said printing blanket.

23. The printing blanket unit of claim 22 wherein said filler material on said at least one end of said printing blanket is spaced from filler material on another end of said printing blanket.

* * * * *

UNITED STATES PATENT AND TRADEMARK OFFICE

CERTIFICATE OF CORRECTION

PATENT NO. : 7,370,579 B2
APPLICATION NO. : 10/538854
DATED : May 13, 2008
INVENTOR(S) : Andreas Kümmet It is certified that error appears in the above-identified patent and that said Letters Patent is hereby corrected as shown below:

In Col. 10, line 11
replace "one of said securement is arranged at said leading end"
with --one of said securement legs is arranged at said leading end--

Signed and Sealed this

Fifteenth Day of July, 2008

JON W. DUDAS
*Director of the United States Patent and Trademark Office*